United States Patent [19]

Cooper et al.

[11] 4,321,586

[45] Mar. 23, 1982

[54] ARTICLE THEFT DETECTION

[75] Inventors: Michael N. Cooper, Flushing; Peter A. Pokalsky, East Meadow, both of N.Y.

[73] Assignee: Knogo Corporation, Hicksville, N.Y.

[21] Appl. No.: 180,101

[22] Filed: Aug. 21, 1980

[51] Int. Cl.[3] ..... G08B 13/18

[52] U.S. Cl. ..... 340/572; 343/6.8 LC

[58] Field of Search ..... 340/572; 343/5 PD, 6.8 LC

[56] References Cited

U.S. PATENT DOCUMENTS

| | | |
|---|---|---|
| 2,794,974 | 6/1957 | Bagno et al. . |
| 3,218,556 | 11/1965 | Chisholm . |
| 3,465,336 | 9/1969 | Fishbein et al. . |
| 3,500,373 | 3/1970 | Minasy . |
| 3,577,136 | 5/1971 | Wolf . |
| 3,624,631 | 11/1971 | Chomet . |
| 3,696,379 | 10/1972 | Minasy . |
| 3,710,336 | 1/1973 | Lerner . |
| 3,781,860 | 12/1973 | Freyling, Jr. . |
| 3,801,977 | 4/1974 | Cotter . |
| 3,810,147 | 5/1974 | Lichtblau . |
| 3,868,669 | 2/1975 | Minasy . |
| 3,885,234 | 5/1975 | Fujimoto ..... 343/5 PD |

FOREIGN PATENT DOCUMENTS

| | | |
|---|---|---|
| 1126996 | 9/1968 | United Kingdom . |
| 1228647 | of 0000 | United Kingdom . |
| 1292380 | 10/1972 | United Kingdom . |

*Primary Examiner*—Glen R. Swann, III

*Attorney, Agent, or Firm*—Fitzpatrick, Cella, Harper & Scinto

[57] ABSTRACT

An electronic article theft detection system accurately senses the presence of a target on a protected article by sensing electromagnetic disturbances at a plurality of frequences, comparing their relative amplitudes and producing a detection signal when the compared relative amplitudes correspond to those produced by the presence of a target.

20 Claims, 13 Drawing Figures

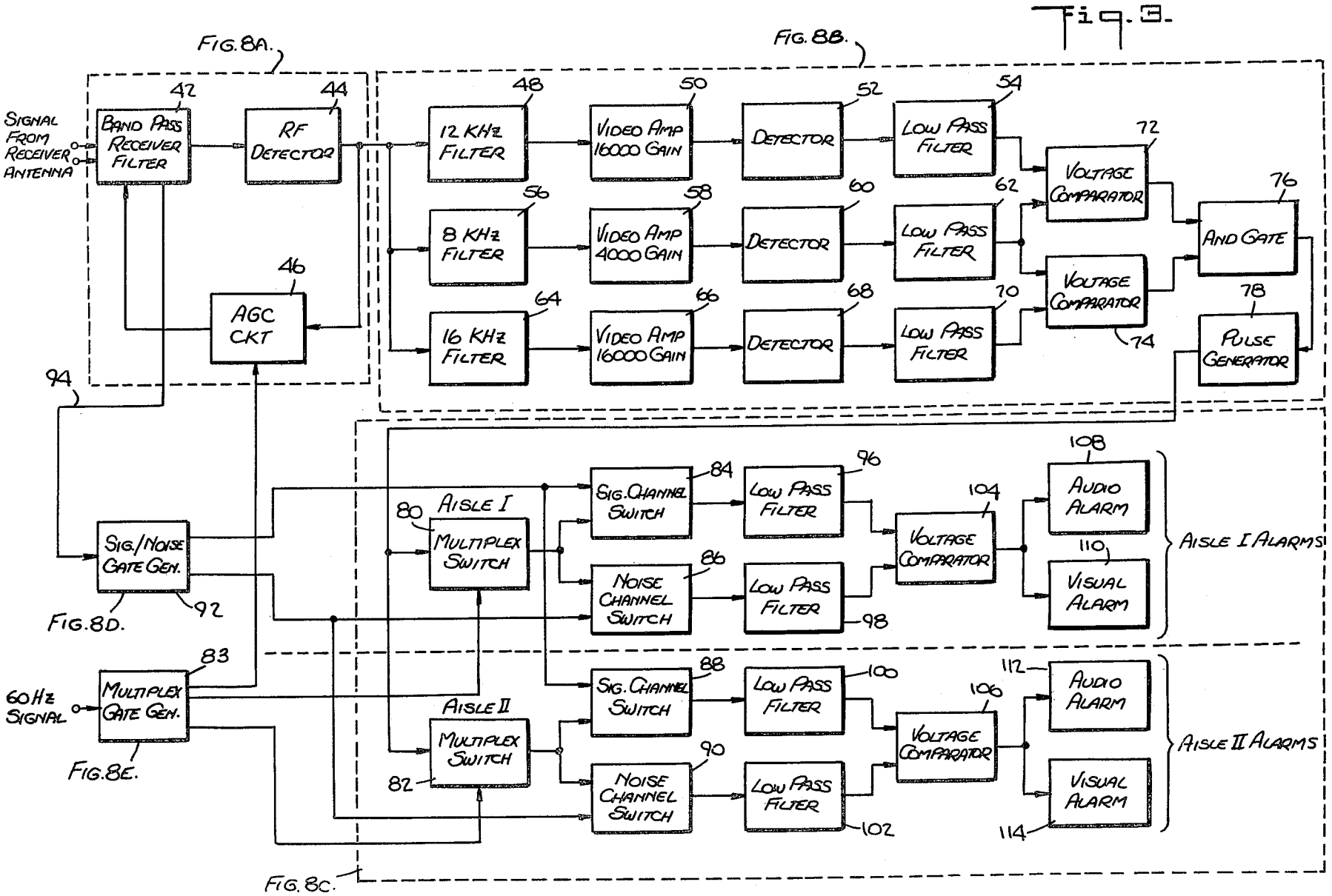
Fig. 8
Fig. 8A.
Fig. 8B.
Fig. 8C.
Fig. 8D.
Fig. 8E.
Signal From Receiver Antenna
Band Pass Receiver Filter
42
RF Detector
44
AGC CKT
46
12 KHz Filter
48
8 KHz Filter
56
16 KHz Filter
64
Video Amp 16000 Gain
50
Video Amp 4000 Gain
58
Video Amp 16000 Gain
66
Detector
52
Detector
60
Detector
68
Low Pass Filter
54
Low Pass Filter
62
Low Pass Filter
70
Voltage Comparator
72
Voltage Comparator
74
And Gate
76
Pulse Generator
78
94
Sig./Noise Gate Gen.
92
Multiplex Gate Gen.
83
60 Hz Signal
Aisle I
Multiplex Switch
80
Aisle II
Multiplex Switch
82
Sig. Channel Switch
84
Noise Channel Switch
86
Sig. Channel Switch
88
Noise Channel Switch
90
Low Pass Filter
96
Low Pass Filter
98
Low Pass Filter
100
Low Pass Filter
102
Voltage Comparator
104
Voltage Comparator
106
Aisle I Alarms
Audio Alarm
108
Visual Alarm
110
Aisle II Alarms
Audio Alarm
112
Visual Alarm
114

N'c
Np'
Sw'
N's
AMPLITUDE
8
9
10
11
12
13
14
15
16
17
18
19
FREQ (KHz)

42
44
46
RF INPUT FROM RECEIVER ANTENNA
MULTIPLEX GATE SIGNAL FROM "F" (FIG. 8E)
VIDEO SIGNAL TO "B" (FIG. 8B)
REF. RF TO "D" (FIG. 8D)
U19
½U1
+15V
-15V
+5V
-5V

ARTICLE THEFT DETECTION

BACKGROUND OF THE INVENTION

1. Field of the Invention

This invention relates to the electronic detection of article theft and more particularly it concerns improvements in the detection of special electronic circuits, known as "targets", which are carried on protected articles.

2. Description of the Prior Art

Electronic article theft detection systems of the type to which this invention applies incorporate a monitor set up at an interrogation zone, such as the exit from a store, library or other area in which protected articles are kept. The protected articles are provided with special targets capable of producing a predetermined electromagnetic field disturbance when they are taken through the interrogation zone and this disturbance is detected by the monitor which in turn actuates an alarm. Authorized passage of the protected article is made possible by removal or deactivation of the target with a special tool or by allowing the article to be taken through a special bypass passageway.

One prior art electronic theft detection system that has been especially successful is shown and described in U.S. Pat. No. 3,500,373. As described in that patent, the monitor includes an antenna which generates in the interrogation zone an interrogating electromagnetic field whose frequency varies cyclically or sweeps at a predetermined rate over a predetermined frequency range. The targets, which are fastened on the protected articles, comprise resonant electrical circuits which resonate at a frequency within the predetermined frequency range. As the frequency of the interrogating field sweeps back and forth across the resonant frequency of a target being carried through the interrogation zone, a series of disturbances, in the form of pulses, is generated. These disturbances are sensed by means of an antenna forming part of the monitor. The antenna converts these disturbances to electrical signals which are detected and used to activate an alarm.

One characteristic common to most electronic theft detection systems is that the signal level or amplitude of the electromagnetic field disturbance produced by the target is extremely low. This is due to several factors. Firstly, in most instances, the target is passive and generates no electromagnetic energy of its own. Secondly, the target must be very small so that it can be affixed to protected articles without impairing their appearance or use. Thirdly, the targets may be carried through the interrogation zone in any random orientation and along any path relative to the field generating and disturbance sensing antennas. Finally, the permissible power of the interrogating electromagnetic field is limited by governmental regulations.

The small amplitude disturbances produced by the targets used for electronic theft detection are especially difficult to sense and detect because of the fact that the detection system is usually required to operate in an environment in which a large amount of extraneous electromagnetic field energy, known as radio frequency noise, is also present. This noise includes natural or background noise (known as Gaussian noise), as well as so-called "man-made noise", such as that produced in the operation of electrical switches, fluorescent lighting, radio equipment and nearby electrical machinery. It has been found that even shopping carts produce radio frequency noise by virtue of the metal surfaces in the wheels rubbing against each other. The amplitude of this extraneous noise may be even greater than the amplitude of the signals produced by the targets themselves.

Various techniques have been proposed in the past for improviding the detectability of low signal level targets in a high noise level environment.

U.S. Pat. No. 3,696,379 proposes to use a second receiving antenna separate from the antenna which monitors the interrogation zone. When signals of a given amplitude are received by the second receiving antenna, a false alarm producing situation is considered to exist and the system is inhibited.

U.S. Pat. Nos. 3,624,631 and 3,810,147 propose to detect the spacing between signals produced when a target is interrogated by a swept frequency interrogating field.

Great Britain Pat. No. 1,292,380 proposes to open a gate in the receiver only during the intervals following transmission of interrogation signals.

U.S. Pat. Nos. 3,710,336; 3,781,860 and 3,868,669 and Great Britain Pat. Nos. 1,126,996 and 1,228,647 all propose to monitor a second frequency in addition to that produced by a true target and to inhibit the system if the other frequency signal level exceeds a predetermined threshold.

U.S. Pat. Nos. 2,794,974; 3,577,136; 3,218,556; 3,465,336 and 3,801,977 all propose to monitor a second or even a third frequency in addition to that produced by a true target and to inhibit the system except when the amplitude of the signal produced at the true target frequency is a predetermined amount above the amplitude of the other frequency signals.

In some of the foregoing patents more than one of the above described techniques are combined.

All of the foregoing prior art operates on the premise that a true target produces signals only at a given frequency, at a given location and at a given time, but that interfering noise signals, occurring at this same frequency, location and time are accompanied by other noise signals which occur at nearby frequencies, location or times. When signals at these other frequencies, locations or times are detected, they are used either to prevent, or to raise the threshold of, target detection. These prior techniques, however, fail to take into consideration that the target itself produces signals over a wide frequency spectrum; and, to the extent that the prior techniques ignore all but a small portion of the target frequency spectrum, or treat all but such small portion as noise signals, they are inherently limited as to how well they can discriminate a true target from extraneous noise.

SUMMARY OF THE INVENTION

The present invention provides novel arrangements for selecting target produced signals which occur in the presence of large noise produced signals. This is achieved, according to the present invention, by making use of the fact that the frequency spectrum of target produced signals is unique and distinct from the frequency spectrum of each of the different types of noise produced signals. Selected frequencies (at least three), are chosen; and the amplitudes of the combined target and noise produced signals at each frequency are compared. When the comparison shows that the relative amplitudes of the combined signals at the chosen frequencies coincide, to a predetermined degree, with the relative amplitudes of the signals at those frequencies produced by a target in the absence of noise, a detection signal output is produced.

According to a further inventive development of the invention the combined signals at the different frequencies are subjected to different gains. The gains for the different frequencies are chosen such that the order of amplitude at the different frequencies for a target produced signal is different from the order of amplitude at those frequencies for the noise signals.

The present invention is carried out by receiving, at an interrogation zone, the electromagnetic fields present in the zone and converting the received electromagnetic fields to corresponding electrical signals. The electrical signals are applied to at least three separate frequency selective channels in parallel, each tuned to pass a different frequency within the range of signal frequencies produced by a target in the interrogation zone. The signals which pass through the frequency selective channels are compared to each other to ascertain their relative amplitude; and when the amplitudes correspond, within predetermined limits, to the amplitude distribution of the response spectrum of a true target, an alarm actuation signal is produced.

In a preferred form of the invention the signals in the different frequency selective channels are subjected to different gains such that the order of output signal amplitude from the channels for signals produced by a target is different from the order of output signal amplitude produced by various noise sources. This permits simple comparisons to be made between the amplitude outputs from the various channels without need to ascertain the exact amount by which the signal amplitude in one channel differs from another channel.

In one of its broader aspects, the present invention provides a novel method of detecting the unauthorized carrying or protected articles through an interrogation zone wherein targets affixed to articles being carried through the zone cause electromagnetic field disturbances which, when received, result in target produced electrical signals having a predetermined spectral characteristic and wherein noise is also present in said interrogation zone in the form of electromagnetic field disturbances which, when received, result in noise produced electrical signals of different predetermined spectral characteristics. This novel method comprises the steps of receiving all of the electromagnetic field disturbances and converting same to electrical signals, applying the electrical signals to at least three frequency selective channels in parallel, each channel being tuned to pass a different frequency within the target produced signal spectrum. The output signal amplitudes from the channels are then compared to ascertain their relative values and a detection signal is produced when the relative values of the compared signal amplitudes correspond, within a predetermined range, to the corresponding relative values of target produced signals.

In another of its broader aspects, the present invention provides novel electronic theft detection apparatus for detecting the unauthorized carrying of protected articles through an interrogation zone. This novel apparatus comprises targets adapted to be affixed to articles carried through the zone, the targets being characterized in that they cause electromagnetic field disturbances in said zone, which disturbances, when received, result in target produced electrical signals having a predetermined spectral characteristic which is different from predetermined spectral characteristics of noise produced electrical signals which result from the reception of other electromagnetic field disturbances in the interrogation zone. Means are provided for receiving the electromagnetic field disturbances in that zone and for converting same to target and noise produced electrical signals. There are also provided at least three frequency selective channels connected in parallel with each other to receive the electrical signals. Each channel is tuned to pass a different frequency within the target produced signal spectrum. Means are provided for comparing the output signal amplitudes from the frequency selective channels to ascertain their selective values and means are also provided for producing a detection signal when the selective values of the compared signal amplitudes correspond within a predetermined range, to the corresponding relative values of target produced signals.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangements for carrying out the several purposes of the invention. It is important, therefore, that this disclosure be regarded as including such equivalent arrangements as do not depart from the spirit and scope of the invention.

BRIEF DESCRIPTION OF THE DRAWINGS

A preferred embodiment of the invention has been chosen for purposes of illustration and description, and is shown in the accompanying drawings, forming a part of the specification, wherein:

FIG. 3 is a block diagram of the receiver portion of the system of FIG. 1;

DETAILED DESCRIPTION OF THE PREFERRED EMBODIMENT

Figures 1, 2:
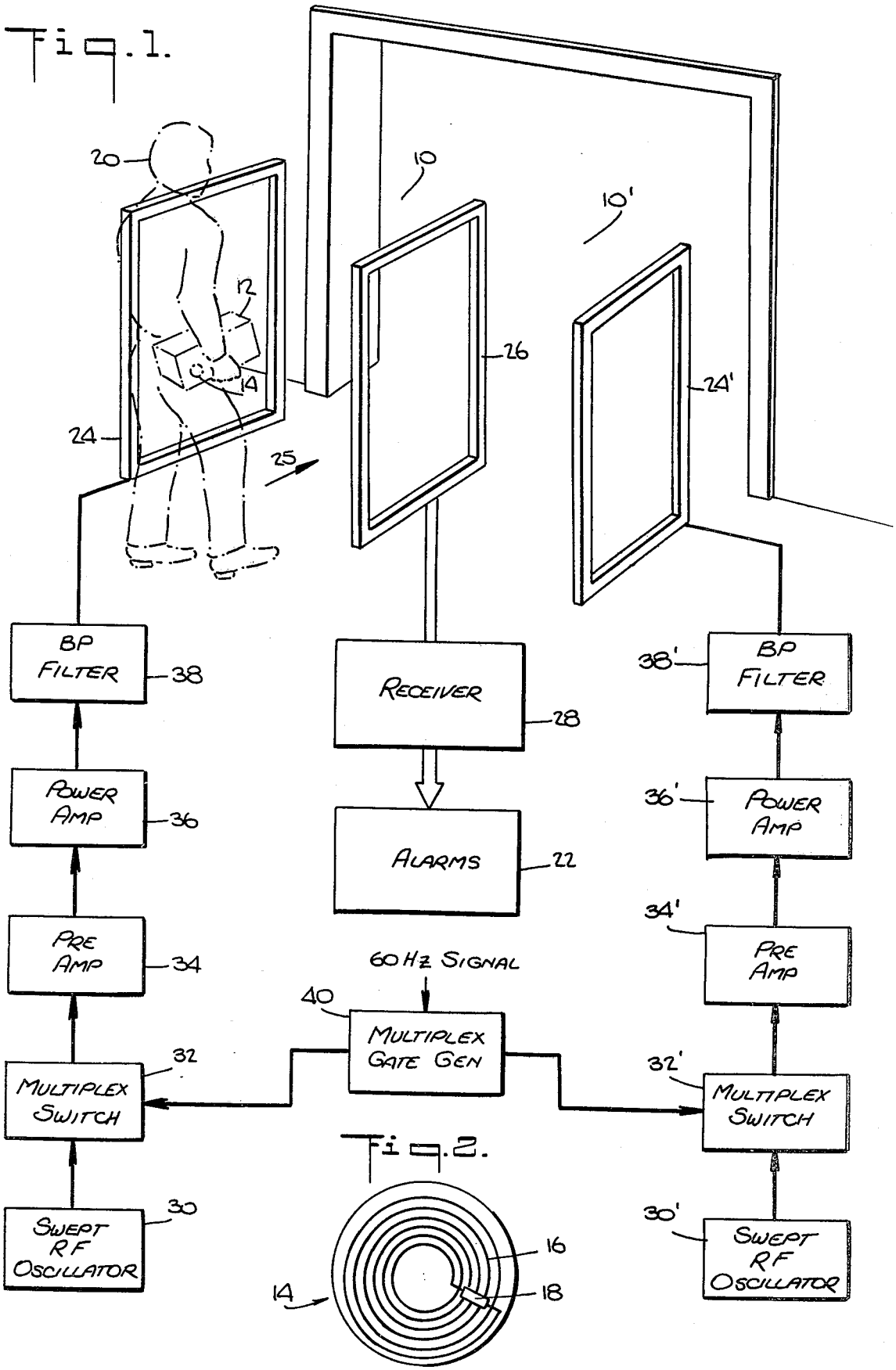
FIG. 1 is a diagrammatic view of an electronic article theft detection system in which the present invention is embodied.
FIG. 2 is an enlarged view of a target used in the system of FIG. 1.

The electronic theft detection system shown in FIG. 1 is used to detect the unauthorized passage of articles through an Aisle I interrogation zone 10 which may, for example, be the exit passageway from a store or a library. Articles to be protected, such as package 12, are provided with a target 14 which, as shown in FIG. 2, comprises a small wafer in which is embedded a resonant electronic circuit made up of a coil 16 and a capacitor 18. In the present case, the resonant electronic circuit of the target 14 is tuned to resonate at 1970 kilohertz (KHZ).

When a proper purchase is made of the protected article, the target 14 is removed or deactivated by a special tool in the custody of the sales clerk or other authorized person. Various types of deactivation and removal tools are known in the art and these do not form part of the present invention.

Should a person, such as a man 20, attempt to carry the package 12 through the Aisle I interrogation zone 10, as shown in FIG. 1, without the target 14 having been removed or deactivated, the detection system will sense the target and will cause an alarm 22 to sound.

The system for detecting targets 14 which pass through the interrogation zone includes a transmitter antenna 24, in the form of a coil, positioned on one side of the zone 10; and a receiver antenna 26, also in the form of a coil, positioned across from the transmitter antenna 24. The space between these two antennas is large enough to permit a person to pass between them; and this space constitutes the Aisle I interrogation zone 10. The transmitter and receiver antennas 24 and 26 each comprise several turns of wire; and, while they are shown to extend in vertical planes, they may, as shown and described in U.S. Pat. No. 4,135,184, be positioned on the floor and overhead, respectively. Also, as shown in U.S. Pat. No. 4,016,553 the antennas may be in the form of bucking loops; or they may each comprise a plurality of partially overlapped loops. The present invention may be used with all of these types of antennas; but for purposes of simplicity only vertical planar loop antennas are shown.

The transmitter antenna 24 is energized to produce an electromagnetic field in the Aisle I interrogation zone 10 which varies in frequency, for example from 1820 kilohertz (KHZ) to 2120 kilohertz (KHZ). This frequency variation occurs continuously in a cyclical sinusoidal manner, for example, at 220 hertz (HZ). When the target 14, which is resonant in the vicinity of 1970 KHZ, is brought into the interrogation zone 10, it encounters an interrogation signal at its resonant frequency twice during each sweep cycle, or at 440 times per second. The target 14 in turn produces electromagnetic field disturbances in the form of pulses which occur at 440 times per second. These electromagnetic field disturbances are sensed by the receiver antenna 26 which in turn produces corresponding electrical signals. These signals are applied to a receiver 28 connected to the receiver antenna 26. The receiver 28, which will be described in greater detail hereinafter, selects those signals which are caused by the targets 14 and distinguishes them from signals produced by extraneous electromagnetic fields, i.e. noise. The target produced signals are then used to actuate the alarm 22.

In order to energize the transmitter antenna 24 there is provided a frequency swept radio frequency oscillator 30 whose output is coupled through a multiplex switch 32 to a preamplifier 34. The preamplifier output is applied to a power amplifier 36. The output from the power amplifier 36 is applied to a bandpass filter 38; and the filter output in turn is connected to energize the transmitter antenna 24. A multiplex gate generator 40 receives a 60 HZ signal, for example, from a common a-c electrical power source; and converts it to a square wave signal. This square wave signal is applied to the multiplex switch 32 and causes it to switch at the 60 HZ rate. Thus the transmitter antenna 24 produces its swept frequency interrogation signals during alternate intervals of 8.33 milliseconds. This corresponds to about 1.83 frequency sweep cycles during each transmission interval.

Of course, other multiplexing intervals can be used; or, if the situation warrants, the multiplexing can be eliminated altogether.

The illustrative embodiment is shown in a form which permits the simultaneous monitoring of an adjacent, or Aisle II, interrogation zone 10'; and for this purpose multiplexing is used to permit these two interrogation zones to be monitored without mutual interference or ambiguity. As shown in FIG. 1, the Aisle II interrogation zone 10' is formed between the receiver antenna 26 and a second transmitter antenna 24' positioned on the opposite side of the receiver antenna 26 from the first transmitter antenna 24. As shown, the output from a second swept frequency oscillator 30' is applied to a second multiplex switch 32' which in turn is controlled by the multiplex gate generator 40 in opposite phase to the first multiplex switch 32. The output from the second multiplex switch 32' is applied to a second preamplifier 34' whose output in turn is connected to a second power amplifier 36'. The output from the second power amplifier 36' is applied via a second bandpass filter 38' to the second transmitter antenna 24'. It will be seen from the foregoing that the two transmitter antennas 24 and 24' are energized during opposite half cycles of the multiplex gate generator 40.

As will be described more fully hereinafter, the receiver 28 also contains multiplexing arrangements which permit the same receiver antenna 26 to receive target generated field disturbances in either interrogation zone 10 or 10' and to energize an appropriate one of the alarms 22 corresponding to the zone in which the target is present.

FIG. 3 shows, in block diagram form, the receiver 28. As can be seen in FIG. 3, there is provided a bandpass receiver filter 42 which is connected to receive electrical signals produced by the receiver antenna 26 in response to received electromagnetic fields. The bandpass receiver filter 42, as will be described more fully hereinafter, serves not only to pass the proper range of signal frequencies, i.e. those produced by the transmitter antennas 24 and 24' and the target 14; but it also provides amplification of the incoming signals. The output from the bandpass receiver filter 42 is applied to a radio frequency (rf) detector 44. The rf detector output is fed back via an automatic gain control circuit 46 to adjust the amplification provided by the bandpass receiver filter 42.

The output from the radio frequency detector 44, which is in the form of video signals, is applied simultaneously to three frequency selective video signal channels. The first channel, referred to herein as the twelve kilohertz channel, comprises a twelve kilohertz filter 48, a video amplifier 50, a detector 52 and a low pass filter 54 all connected in series. The second channel, referred to herein as the eight kilohertz channel, comprises an eight kilohertz filter 56, a video amplifier 58, a detector 60 and a low pass filter 62; also connected in series. The third channel, referred to herein as the sixteen kilohertz channel, comprises a sixteen kilohertz filter 64, a video amplifier 66, a detector 68 and a low pass filter 70 all connected in series.

The three frequency selective video signal channels are identical except in two respects. Firstly, as mentioned, the first filters 48, 56 and 64 in the respective channels are tuned to pass twelve, eight and sixteen kilohertz respectively. Secondly, the gain of the video amplifiers 50 and 66 in the twelve and sixteen kilohertz channels is four times greater than the gain of the video amplifier 58 in the eight kilohertz channel. In the embodiment disclosed, the gain of the video amplifiers 50 and 66 in the twelve and sixteen kilohertz channels, is chosen to be 16,000 whereas the gain of the video amplifier 58 in the eight kilohertz channel is chosen to be 4000. The significance of this will be explained in connection with FIGS. 5 and 6.

The outputs of the low pass filters 54 and 62 of the twelve and eight kilohertz channels are applied to a twelve/eight kilohertz channel voltage comparator 72; and the outputs of the low pass filters 62 and 70 of the eight and sixteen kilohertz channels are applied to an eight/sixteen kilohertz channel voltage comparator 74. The voltage comparator 72 is constructed and arranged to produce an output signal whenever the signal from the eight kilohertz channel is of lesser voltage amplitude than the signal from the twelve kilohertz channel. Also, the voltage comparator 74 is constructed and arranged to produce an output signal whenever the signal from the eight kilohertz channel is of greater voltage amplitude than the signal from the sixteen kilohertz channel.

The outputs from the two voltage comparators 72 and 74 are applied to an AND gate 76; and the output from the AND gate is applied to a pulse generator 78. It will be appreciated that signals are applied from the AND gate 76 to the pulse generator 78 whenever the signal amplitude from the eight kilohertz channel is less than that from the twelve kilohertz channel but greater than that from the sixteen kilohertz channel.

Each input from the AND gate 76 to the pulse generator 78 causes the pulse generator to produce a pulse of precisely defined height and width. In the preferred embodiment the pulses have a height of fifteen volts and a width of 250 microseconds.

The output from the pulse generator 78 is applied to an Aisle I multiplex switch 80 and an Aisle II multiplex switch 82.

These switches are in turn controlled by a multiplex gate generator 83 which may be the multiplex gate generator 40 (FIG. 1) associated with the transmitter. In any event, the gate generator 83 applies 60 cycle per second square wave signals to the multiplex switches 80 and 82 so that each will be closed to pass signals from the pulse generator 78 at alternate times corresponding to the intervals that the transmitter antennas 10 and 10' (FIG. 1) are being energized.

The pulse signals which pass through the multiplex switch 80 are applied simultaneously to an Aisle I signal channel switch 84 and an Aisle I noise channel switch 86. Similarly the pulse signals which pass through the multiplex switch 82 are applied simultaneously to an Aisle II signal channel switch 88 and to an Aisle II noise channel switch 90. The signal channel switches 84 and 88 are connected to output of a signal/noise gate generator 92 while the noise channel switches 86 and 90 are connected to another output of the signal/noise gate generator 92. The signal/noise gate generator 92 is energized in synchronism with the frequency sweep of the transmitted interrogation signals so that the first output, applied to the signal channel switches 84 and 88 is at a level sufficient to close those switches to pass pulse signals generated during those portions of the frequency sweep when the transmitter frequency is in the vicinity of the target resonant frequency, i.e. 1970 kilohertz. During this time the other output from the signal/noise gate generator 92, which is applied to the noise channel switches 86 and 90, keeps those switches open so they do not pass any pulse signals which are generated during this time. Then, during the remaining portions of the frequency sweep cycle, when the transmitter frequency is outside the resonant frequency of the targets, the outputs from the signal/noise gate generator 92 are reversed so that the noise channel switches 86 and 90 pass any pulse signals generated during that time but the signal channel switches 84 and 88 do not.

The signal/noise gate generator 92 must be driven in synchronism with the transmitter frequency sweep cycle. In order to synchronize this driving of the gate generator 92, signals may be provided from the transmitter itself. In some instances this is not feasible and in such cases, the received signals from the receiver bandpass filter 42 may be applied via a signal/noise gate synchronization line 94 as shown in FIG. 3.

The signal and noise channel switches 84, 86, 88 and 90 are connected to associated low pass filters 96, 98, 100 and 102. The filters 96 and 98 for the Aisle I signal and noise channel switches 84 and 86 are connected to an Aisle I signal to noise voltage comparator 104; and the filters 100 and 102 for the Aisle II signal and noise channel switches 88 and 90 are connected to an Aisle II signal to noise voltage comparator 106. The low pass filters 96, 98, 100 and 102 accumulate pulses from the pulse generator 78 which are directed into them by the multiplex switches 80 and 82 and the signal and noise channel switches 84, 86, 88 and 90. These low pass filters thus build up an output voltage corresponding to the number of pulses applied to them. When the output voltage from either of the signal channel low pass filters 96 or 100 exceeds, by a predetermined amount, e.g. 0.7 volts, the output voltage from its associated noise channel low pass filter 98 or 102, the associated voltage comparator 104 or 106 will respond to this voltage difference and produce an alarm actuating signal. As shown in FIG. 3, the alarm actuating signal from the voltage comparator 104 is applied to an Aisle I audio alarm 108 and an Aisle I visual alarm 110 while the alarm actuating signal from the voltage comparator 106 is applied to an Aisle II audio alarm 112 and an Aisle II visual alarm 114. The number and arrangement of alarms may, of course, be varied. These alarms together constitute the alarms 22 of FIG. 1.

Figure 4:
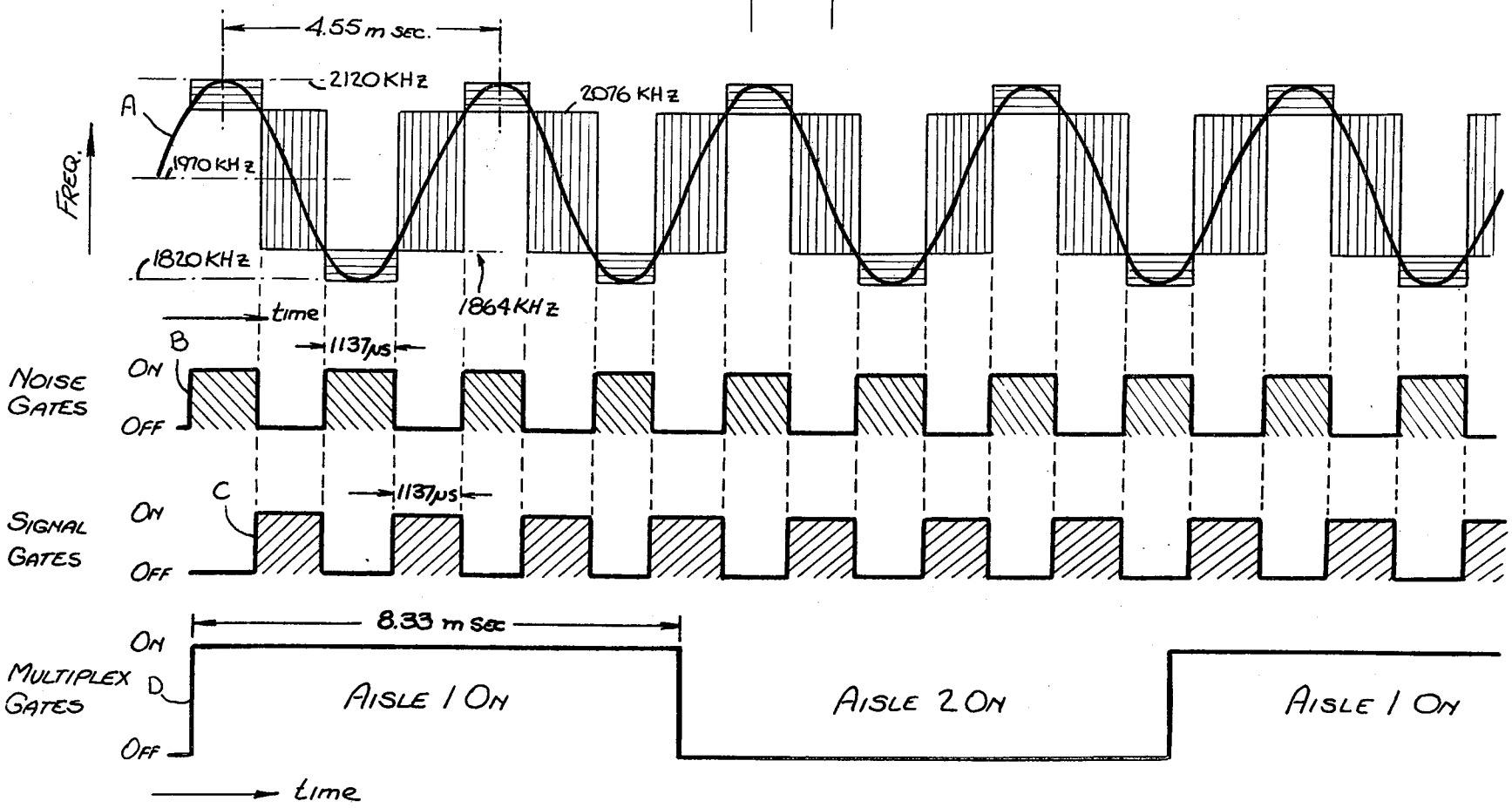
FIG. 4 is a timing diagram showing gating and signal waveforms at various portions of the receiver of FIG. 3.

The overall operation of the electronic theft detection system of FIGS. 1–3 will now be described in conjunction with the timing diagram of FIG. 4. Curve A of FIG. 4 is a plot of the variation in frequency of the signal from the swept frequency oscillator 30. As can be seen, this frequency varies from 1820 KHZ to 2120 KHZ in a cyclical sinusoidal manner over a period corresponding to 220 HZ, i.e. 4.55 milliseconds. At the same time, the multiplex switches 32 and 32' direct this swept frequency signal alternately to the separate transmitter antennas 24 and 24' over intervals corresponding to one half the period of the 60 HZ multiplex switching signal, i.e., 8.33 milliseconds. That is, the swept frequency signal from oscillator is applied first to energize the Aisle I transmitter antenna 24 for a duration of 8.33 milliseconds and then is applied to energize the aisle two transmitter antenna 24' for a duration of 8.33 milliseconds. This is illustrated by square wave D of FIG. 4.

It will be seen that each aisle receives signals for 8.33/4.55 or 1.83 frequency sweep cycles during each interval that its transmitter antenna 24 or 24' is being energized.

The swept frequency electromagnetic fields generated alternately in the Aisle I and Aisle II interrogation zones 10 and 10' by the above described alternate energization of the transmitter antennas 24 and 24' are disturbed by the presence of resonant electronic circuits such as the targets 14 when they are mounted on protected articles carried through those interrogation zones. Each target 14 is sharply tuned to resonate at a frequency substantially midway of the swept frequency range, i.e. about 1970 KHZ. Thus, two disturbances occur during each full frequency sweep cycle and an average of 3.66 target produced disturbances occur during each interval that one of the transmitter antennas 24 or 24' is being energized.

All of the electromagnetic field disturbances produced in the Aisle I and Aisle II interrogation zones 10 and 10' are received by the common receiver antenna 26 and are passed through the bandpass receiver filter 44 and the radio frequency detector 44 and are applied to the three frequency selective channels controlled respectively by the twelve, eight and sixteen KHZ filters 48, 56 and 64. As will be described more fully hereinafter, the electrical signals resulting from these field disturbances are processed in the frequency selective channels, the voltage comparators 72 and 74 and the AND gate 76 to select those which most resemble the spectrum of a resonant target produced disturbance; and the selected signals are all converted in the pulse generator 78 to pulses of standard amplitude (e.g. about 15 volts) and duration (e.g. about 250 microseconds).

The multiplex gate signal D of FIG. 4 is applied to the multiplex switches 80 and 82 of the receiver as shown in FIG. 3. Accordingly, any pulses produced by the pulse generator 78 while the Aisle I transmitter antenna 24 is being energized will be directed through Aisle I receiver circuits for signal to noise processing and possible energization of the Aisle I alarms 108 and 110. Conversely, any pulses which are produced by the pulse generator 78 while the Aisle II transmitter antenna 24' is being energized will be directed through the Aisle II receiver circuits for signal to noise processing and possible energization of the Aisle II alarms 112 and 114.

The signal to noise processing is carried out, as shown in curves A, B and C of FIG. 4 by dividing the swept frequency into a signal channel, corresponding to those frequencies nearer the center of the sweep range, and a noise channel corresponding to those frequencies nearer the extremities of the sweep range. In the presently preferred embodiment the signal and noise channels are chosen to have equal duration with the signal channels centered about the midfrequency of the sweep range (represented by vertical shading lines on curve A) and with the noise channels centered about the extreme frequencies of the sweep range (represented by horizontal shading lines on curve A). With a sinusoidal frequency sweep from 1820 KHZ to 2120 KHZ at a 220 HZ rate, two noise gates (curve B) and two signal gates (curve C), each of 1137 microseconds, occur during each frequency sweep cycle. Further, the signal gates include those portions of the frequency sweep cycle when the transmitted frequency is between 1864 KHZ and 2076 KHZ. The noise gates include those portions of the frequency sweep cycle when the transmitter frequency is less than 1864 KHZ or greater than 2076 KHZ. Electromagnetic field disturbances which occur during a signal gate, i.e. curve C of FIG. 4, may be expected to result from the presence of a true target since the target curcuits are tuned to resonate substantially in the center of the signal gate frequency range. Those signals which occur during a signal gate are processed in a signal channel. If, however, signals occur during a noise gate, i.e. curve B of FIG. 4, such signals may be expected to result from some extraneous circumstance rather than from a true target because the circuits of true targets are tuned not to resonate in response to the frequencies being transmitted during the noise gate. Any signals which occur during a noise gate are processed in a noise channel and are used to inhibit the signals processed in the signal channel. This inhibiting function is carried out because false signals, i.e. ones which are not produced by a true target, and which are detected during the noise gates, are often accompanied by false signals during the neighboring signal gates. Thus when signals are produced during noise gates, this indicates that the signals produced during the neighboring signal gates are of questionable validity.

The noise and signal gating signals, represented by the curves B and C in FIG. 4, can be generated in the transmitter and supplied via signal and noise gate switching lines to the receiver. However, in the present embodiment the signal and noise gating signals are derived from the swept frequency transmitter signals as received at the bandpass receiver filter 42 in the receiver. As will be explained more fully hereinafter, the received transmitter signals are supplied via the line 94 (FIG. 3) to the signal/noise gate generator 92 which uses those signals to produce noise gate signals, corresponding to curve B of FIG. 4, and signal gate signals, corresponding to curve C of FIG. 4. When the signal gate signals are in their "ON" state the signal channel switches 84 and 88 are closed so that, depending on which of the multiplex switches 80 and 82 is closed, the pulses being produced in the pulse generator 78 will pass through to one of the signal channel low pass filters 96 and 100. During alternative times, i.e. when the noise gate signals are in their "ON" state, the noise channel switches 86 and 90 are closed and pulses from the pulse generator 78 will pass through to one or the other of the noise channel low pass filters 98 or 102.

The signal channel low pass filters 96 and 100 are constructed to require the reception of at least ten pulses from the pulse generator 78 without any pulses being supplied to their associated noise channel low pass filters 98 and 102 in order to achieve the necessary 0.7 volts output voltage differential which will enable the voltage comparator 104 or 106 to produce an alarm actuating signal. If, during the time that signal channel low pass filters are receiving charging pulses, pulses are also being received in the noise channel low pass filters 98 and 102, a greater number of pulses must be accumulated by the signal channel low pass filters 96 and 100 to achieve the necessary 0.7 volts output voltage differential.

As pointed out above, only 1.83 frequency sweep cycles occur during each multiplexing interval; and, with a true target present, only 3.66 target produced disturbances will occur during each multiplexing interval. In order to permit the low pass filters 96 and 100 in the signal channels to accumulate the necessary ten or more pulses, it is necessary to accumulate the pulses produced during one multiplexing interval with pulses produced during subsequent multiplexing intervals. As will be explained more fully hereinafter, all of the signal and noise low pass filters 96, 98, 100 and 102 are constructed to maintain each charge imposed on them during the multiplexing intervals when they are not receiving pulses. Thereafter, when each signal or noise low pass filter later begins to receive additional pulses during a subsequent multiplexing interval, the new pulses are accumulated with those received during a previous multiplexing interval.

Thus far there has been described two ways in which the electronic theft detection system of FIGS. 1–3 operates to select target produced signals from extraneous noise or false signals. The first way makes use of multiplexing to prevent the field disturbances produced in one interrogation zone from affecting the sensing being carried out in an adjacent interrogation zone. The second way makes use of signal and noise gating so that field disturbances produced when the transmitter frequency is outside the target resonance range inhibit the production of alarm signals resulting from disturbances sensed when the transmitter frequency is within the target resonance range.

The third way in which the electronic theft detection system of FIGS. 1–3 operates to select target produced signals from extraneous noise is to identify those received signals whose frequency spectrum corresponds, within predetermined limits, to that of a resonant circuit target. The manner in which this is carried out is best seen in the graphs of FIGS. 5 and 6.

Figure 5:
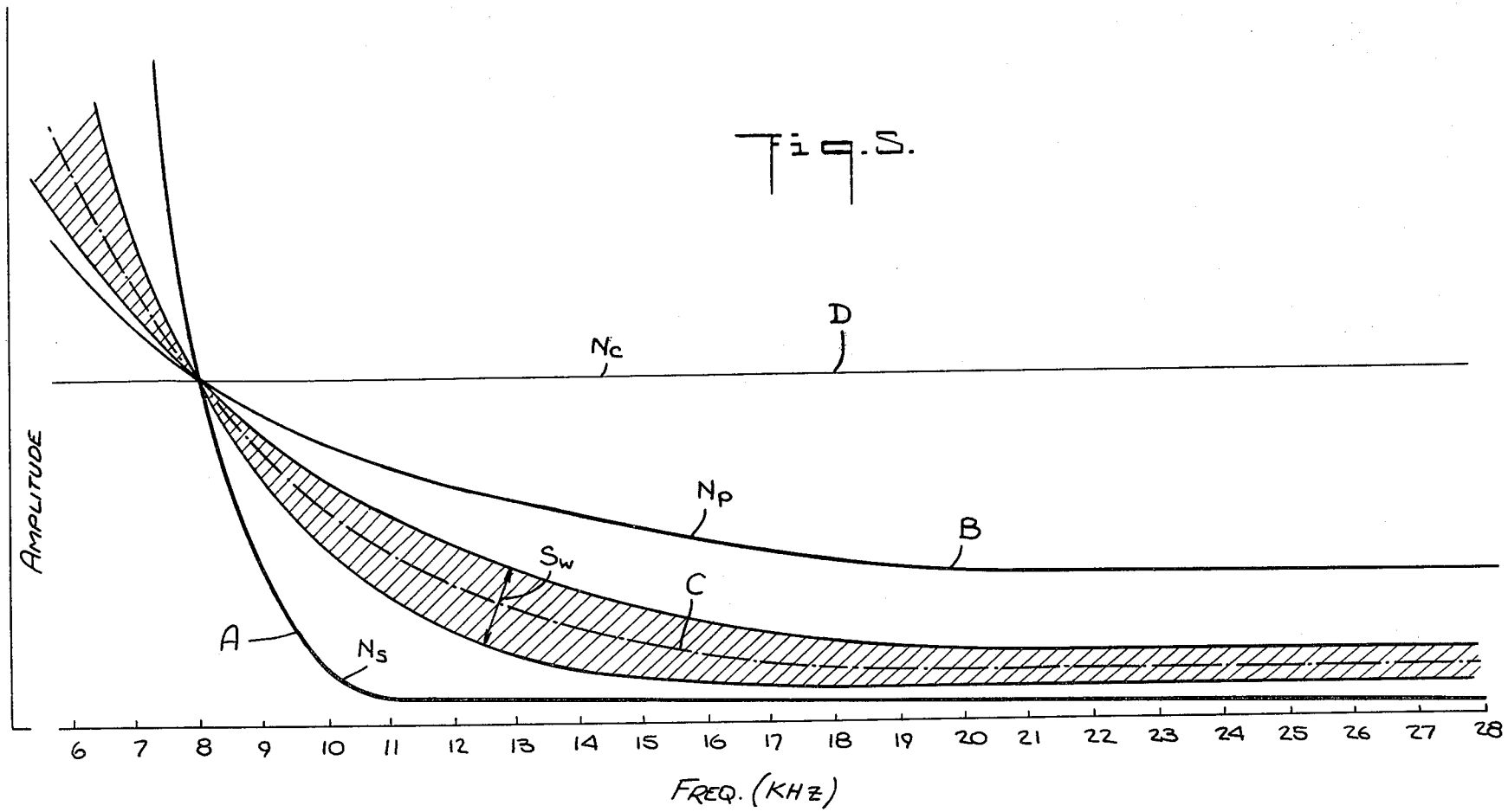
FIG. 5 is a line graph illustrating the frequency spectrum characteristics of signals from different sources which are present in the receiver of FIG. 3.
Figure 6:
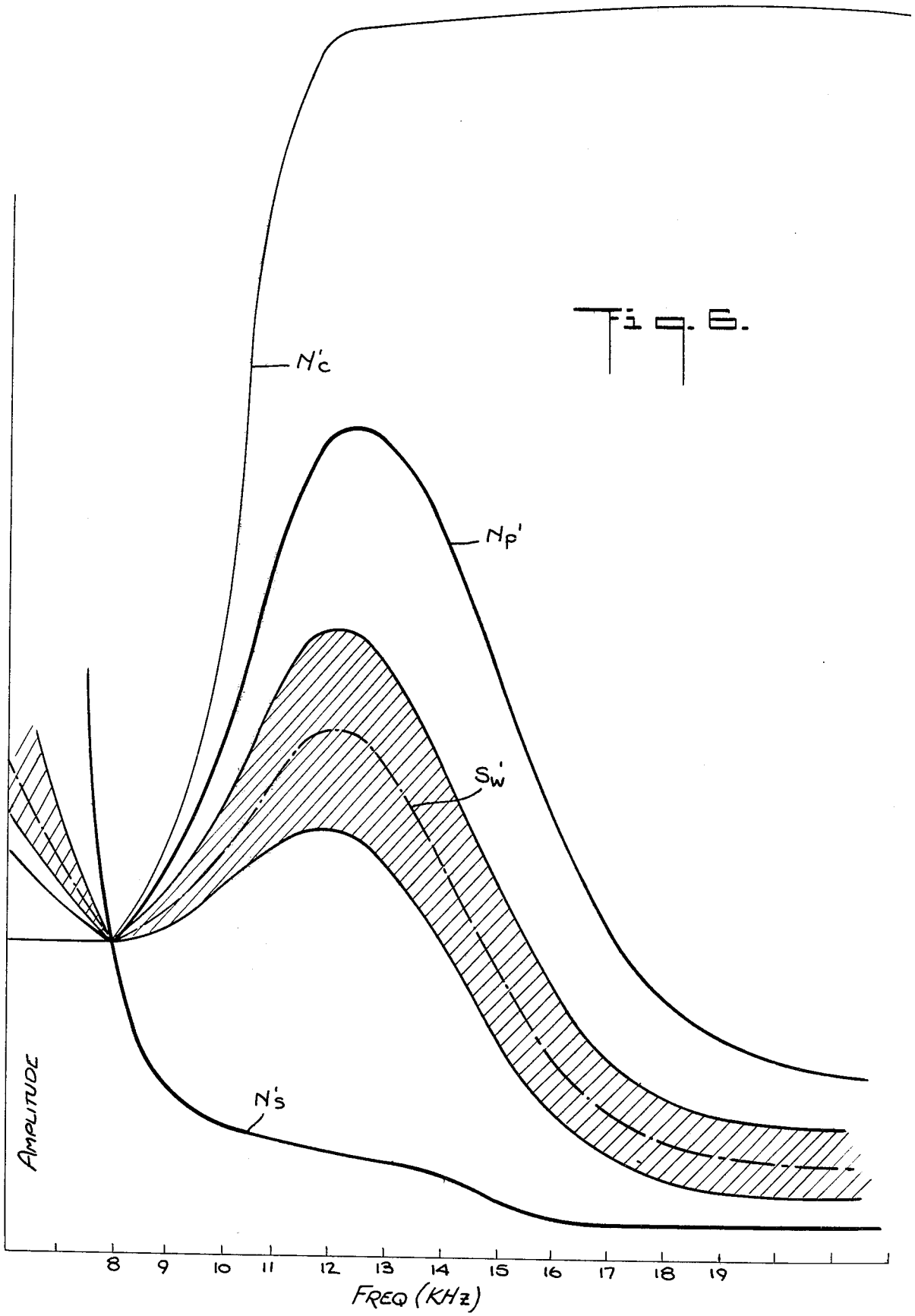
FIG. 6 is a line graph similar to FIG. 5 but showing the effect of selective gain adjustment at different frequencies.

FIG. 5 is a plot of the spectral characteristics, i.e. amplitude versus frequency, of signals produced at the output of the receiver rf detector 44 in response to electromagnetic field disturbances from each of several different sources, namely, target produced disturbances ($S_w$), continuous wave noise ($N_c$), pulse noise ($N_p$) and so-called shopping cart noise ($N_s$). Continuous wave noise ($N_c$) is the natural electromagnetic background noise which pervades in the atmosphere and, as shown, it is substantially uniform in amplitude throughout the frequency spectrum. Pulse noise ($N_p$) is the result of electromagnetic field disturbances which occur in the form of sudden bursts such as from the operation of switches, electrical machinery, fluorescent lamps, etc. Pulse noise is generally referred to as man-made noise, although some of this noise is caused by natural phenomena, such as lightning. The spectral characteristic of pulse noise can be defined by the equation $N_p=K/f$ where K is a constant and f is the frequency of the noise. The frequency spectrum of this noise is represented by the line ($N_p$) in FIG. 5. So-called "shopping-cart noise" ($N_s$) is a type of man-made noise whose effects are apparently of significance only in the field of electronic theft detection. It has been found that when two pieces of metal are rubbed over each other, such as occurs in the casters of a shopping cart being pushed through a doorway, there is produced, at least during the occurrence of interrogation signals, a low amplitude, yet appreciable, electromagnetic field disturbance having a spectral characteristic such as represented by the line ($N_s$) in FIG. 5.

The spectral characteristic of target produced electromagnetic field disturbances ($S_w$) is defined by the equation $S_w=e^{-fK/Q}$ where e is the base of natural logarithms, f is the frequency of the field disturbance, K is a constant and Q is the resonance characteristic of the target circuit. The band of curves in FIG. 5 representing target produced disturbances ($_S$w), correspond to target circuits having different Q values.

Any one or more of the different noise signal amplitudes, or the target signal amplitude, may be higher or lower than as shown in FIG. 5. Nevertheless each maintains its unique relationship of amplitude to frequency; that is, its spectral characteristics remain essentially the same. The present invention uses this fact to ascertain the presence of target produced signals and to distinguish these signals from the various noise produced signals even though the target produced signals may be of very low amplitude. That is, according to the present invention, a target is selected when the relative amplitudes of all of the received signals at each of several frequencies correspond, within a preselected range, to the relative amplitudes of only target produced signals at those frequencies. Because the spectral curves of the target and most noise produced signals are defined by a non-linear or higher order function, signal amplitudes are sampled and compared for at least three different frequencies, for example, frequencies at eight, twelve and sixteen kilohertz.

It can be seen from FIG. 5 that the continuous wave noise ($N_c$) is at the same amplitude in each of the selected frequencies while the pulse noise ($N_p$), the shopping cart noise ($N_s$) and the target produced signals ($S_w$) are all at progressively lower amplitude at increasing frequencies. Therefore it is not possible, simply by comparing signal amplitudes at different frequencies, to distinguish target produced signals ($S_w$) from pulse noise ($N_p$) or from shopping cart noise ($N_2$).

As shown in FIG. 3, the signal and noise in the different frequency selective channels is subjected to different amounts of gain due to the different gain characteristics of the video amplifiers 50, 58 and 66 in each of the channels. Specifically, the signals and noise in the eight kilohertz channel are subjected to a gain in the video amplifier 58 of 4000 while the signals and noise in each of the twelve and sixteen kilohertz channels are subjected to a gain of 16,000.

The effect of these different amounts of gain is shown in FIG. 6. In FIG. 6 the curves ($N_c'$), ($N_p'$) and $N_s'$) correspond respectively to the curves ($N_c$), ($N_p$), ($S_w$) and ($N_s$) of FIG. 5 except that the curves in FIG. 6 represent the frequency spectrum of the signals when they have been subjected to different amounts of gain at different frequencies. It can be seen from FIG. 6 that with the selective gain provided in the different frequency selective channels, the relative order of amplitude of the target signals at the different frequencies is different from the relative order of amplitude of each of the different types of noise at those frequencies. This is seen in the following table:

TABLE I

| Signal or Noise | Order of Amplitude at Selected Frequencies |
|---|---|
| Continuous Noise ($N_c$) | 12 KHZ = 16 KHZ > 8 KHZ |
| Pulse Noise ($N_p$) | 12 KHZ > 16 KHZ > 8 KHZ |
| Shopping Cart Noise ($N_s$) | 8 KHZ > 12 KHZ > 16 KHZ |
| Target Signal ($S_w$) | 12 KHZ > 8 KHZ > 16 KHZ |

With the selective gain provided in the different frequency channels, the spectrum of the target signal ($S_w$) assumes a configuration such that its order of amplitude at different frequencies is unique and unlike the order of amplitude of any of the different types of noise at those frequencies. That is, only the target signal spectrum provides a maximum amplitude in the 12 KHZ channel, an intermediate amplitude in the 8 KHZ channel and a minimum amplitude in the 16 KHZ channel. This unique target produced amplitude relationship, moreover, is independent of the amplitude of either the target signals or any of the various types of noise. Thus, whenever the output amplitude from the 8 KHZ channel is less than that from the 12 KHZ channel but greater than that from the 16 KHZ channel this may be attributed to the presence of a target, even though the amplitudes of these signals may be very high or very low. In this manner the invention avoids false alarms which might otherwise be caused by non-target interfering noise.

The present invention also permits true targets to be detected even in the presence of a certain amount of various types of noise signals. These various types of noise signals pass through the various frequency selective channels together with the target signals and combine with them additively in each channel. Since these interfering or noise signals have amplitude relationships at the selected frequencies which are different from those produced by true targets, they may in some cases overwhelm the true target signals and produce combined signals at the frequency channel output whose amplitude relationships do not coincide with that of true targets. Nevertheless these various noise sources do not prevent the detection of a true target unless they are high enough in amplitude to cause a rearrangement in amplitude order of the combined signals from the various frequency channels. The amplitude at which these interfering signals will cause such rearrangement depends on the difference in amplitude produced by a true target at the selected frequencies. As can be seen in the band (Sw') of FIG. 6, target circuits of higher Q characteristic (represented by ($S_{w'H}$) are less affected by the influences of other disturbances than target circuits of low Q (represented by ($S_{w'L}$). That is, a high Q target produces signal outputs such that the difference in amplitudes at eight, twelve and sixteen kilohertz is maximized and therefore a large amount of interfering noise is required to change the order of the output amplitudes at these frequencies in FIG. 6.

Figure 7A:
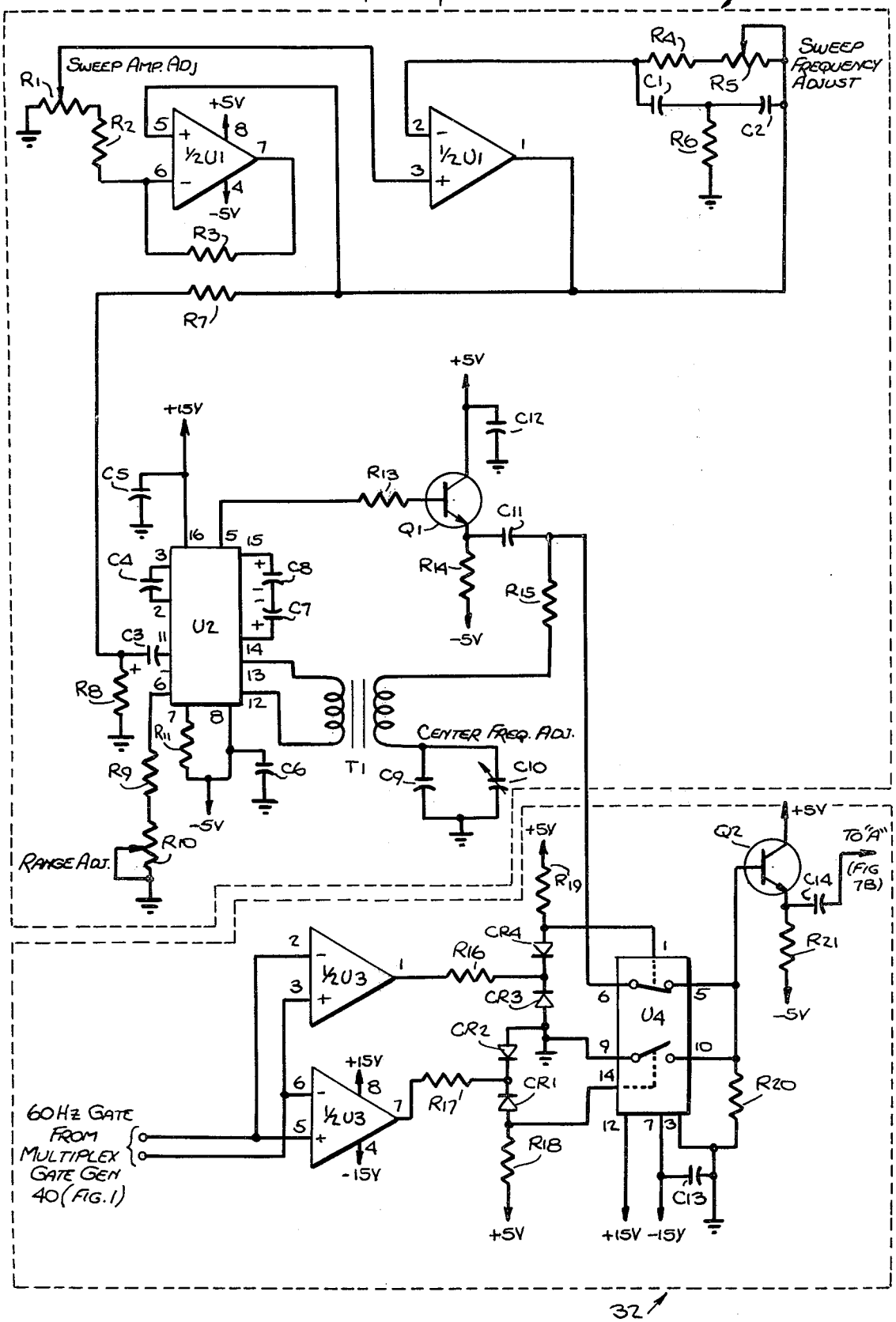
FIGS. 7A and 7B together constitute a circuit diagram of the transmitter portion of the electronic theft detection system of FIG. 1.
Figure 7B:
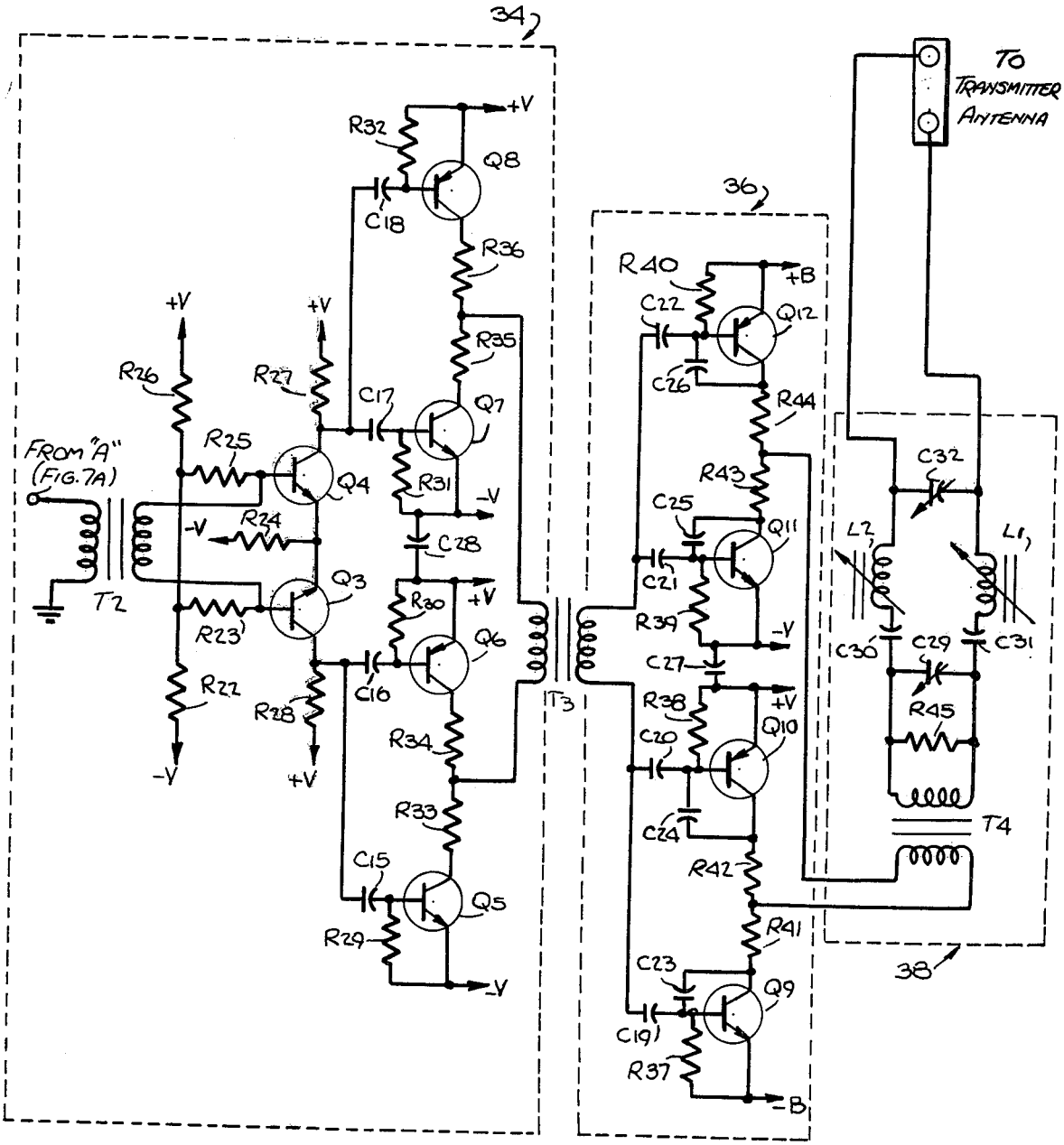
Figure 8A:
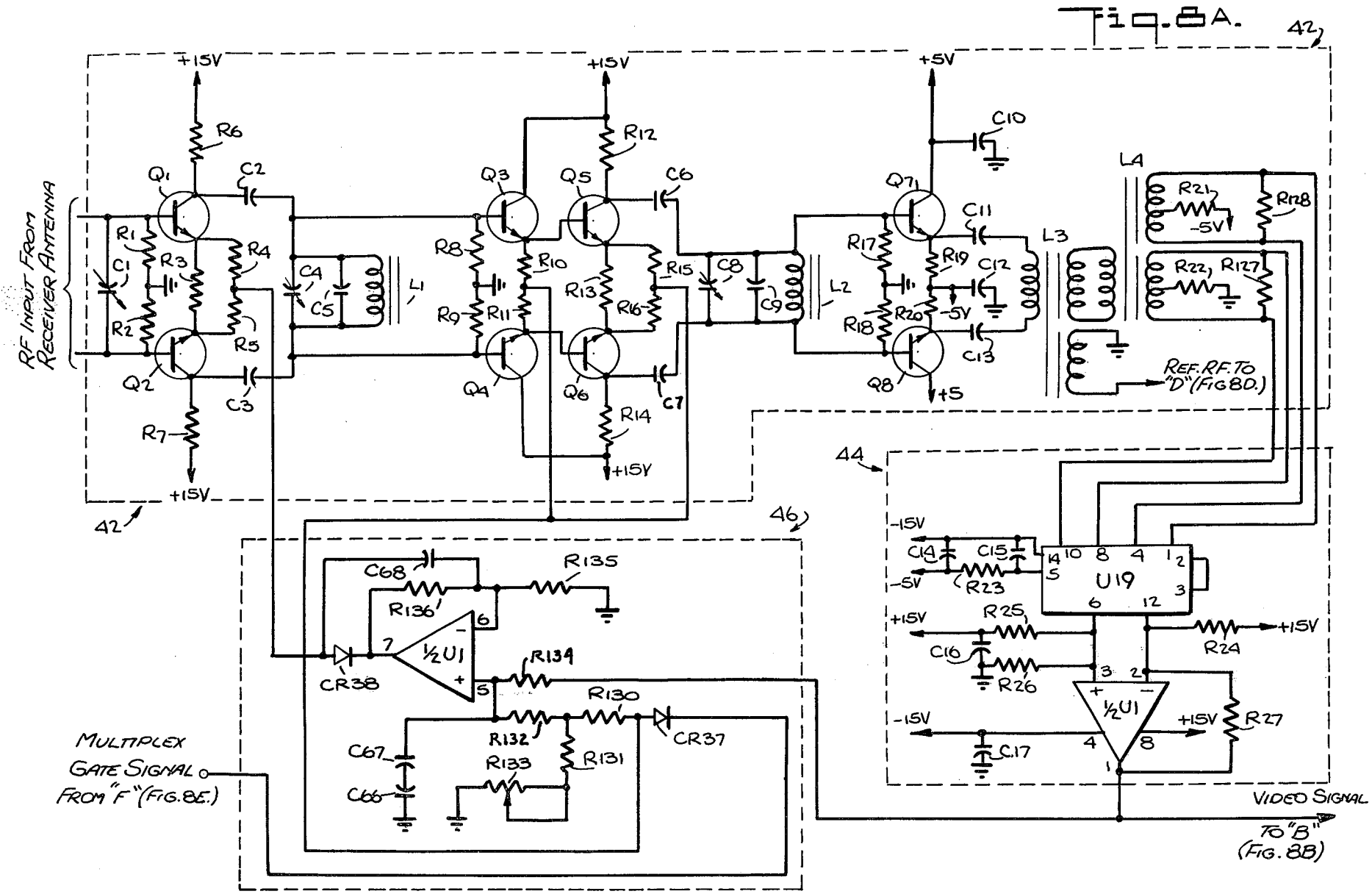
FIGS. 8A–E together constitute a circuit diagram of the receiver portion of the electronic theft detection system of FIG. 1.
Figure 8B:
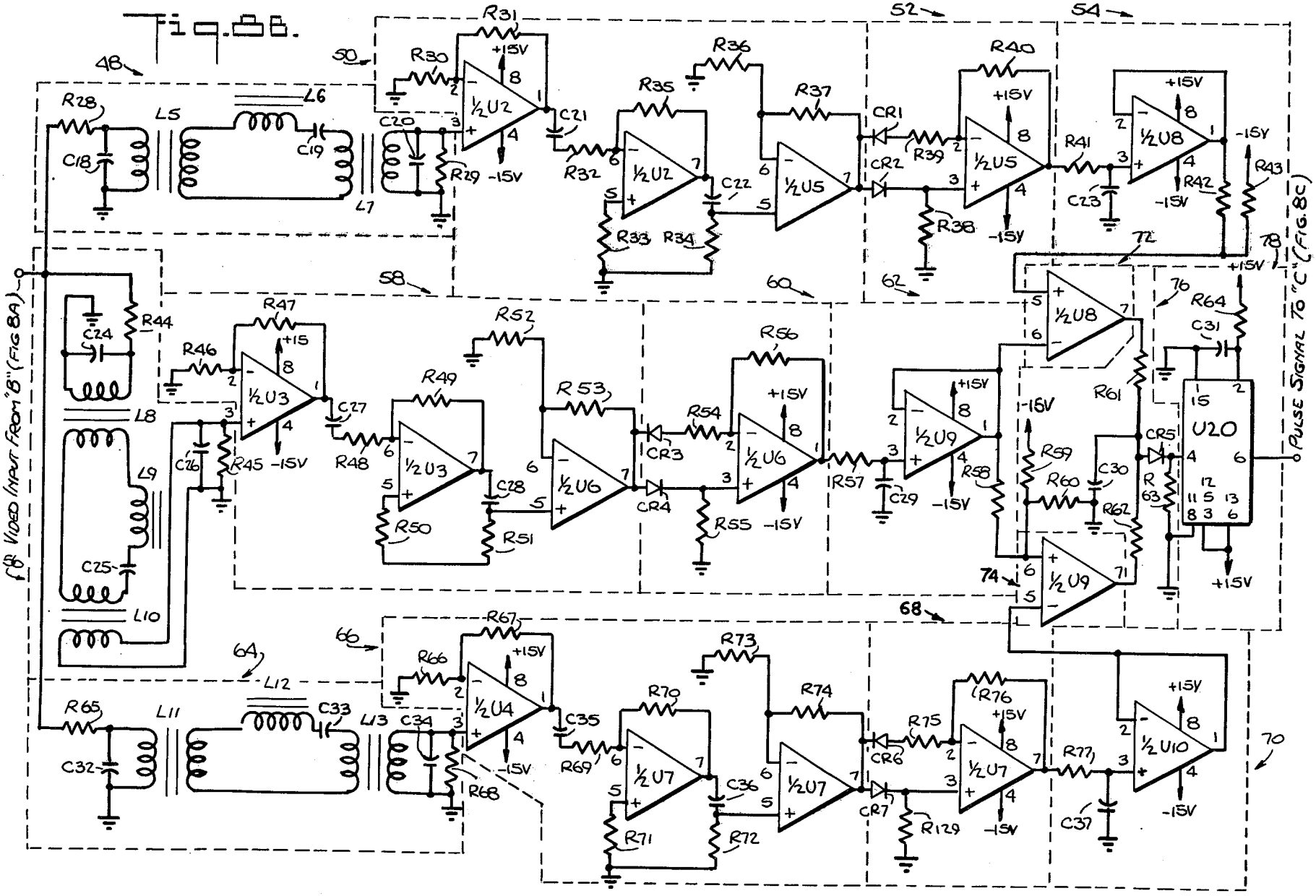
Figure 8C:
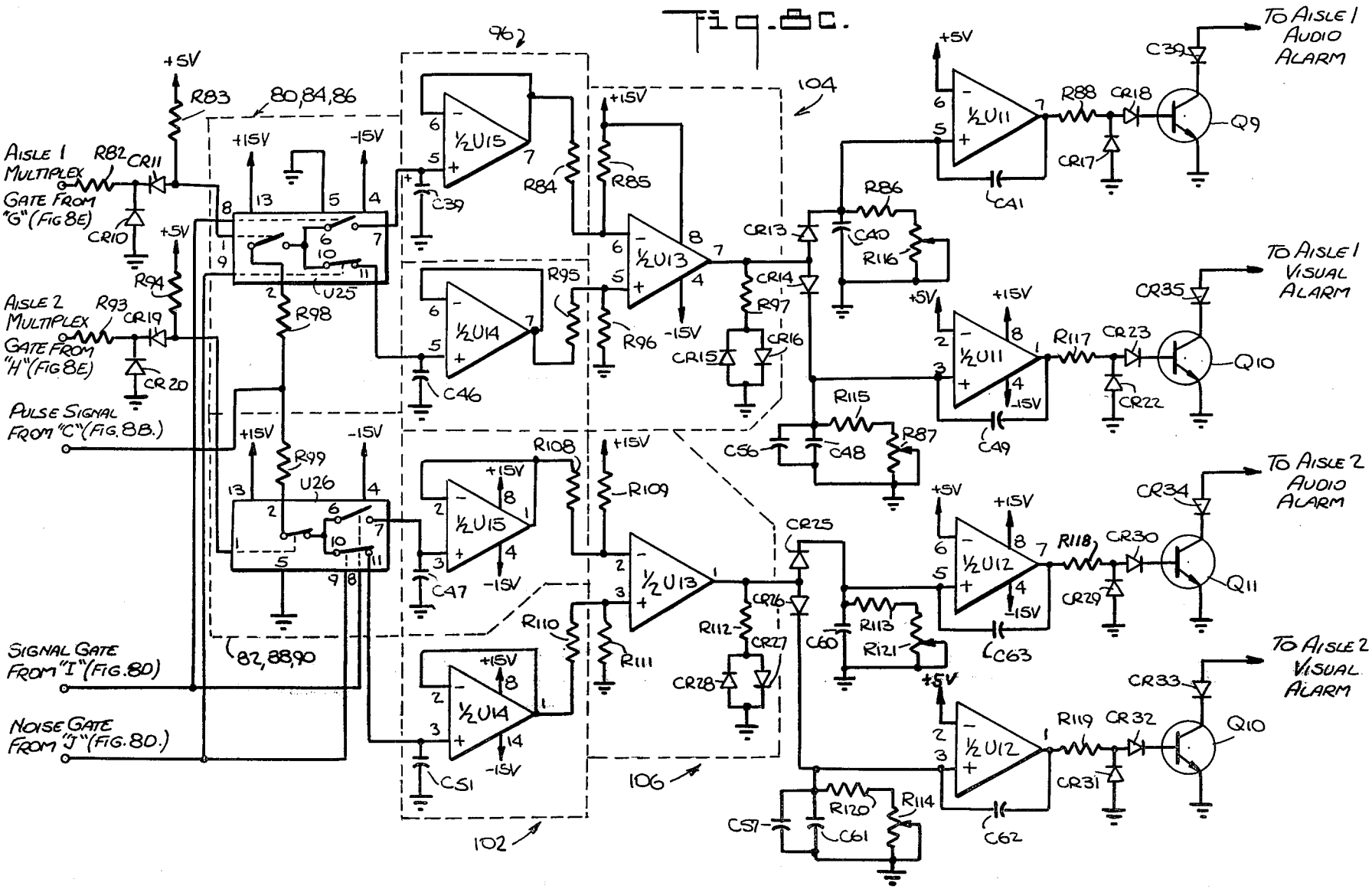
Figures 8D, 8E:
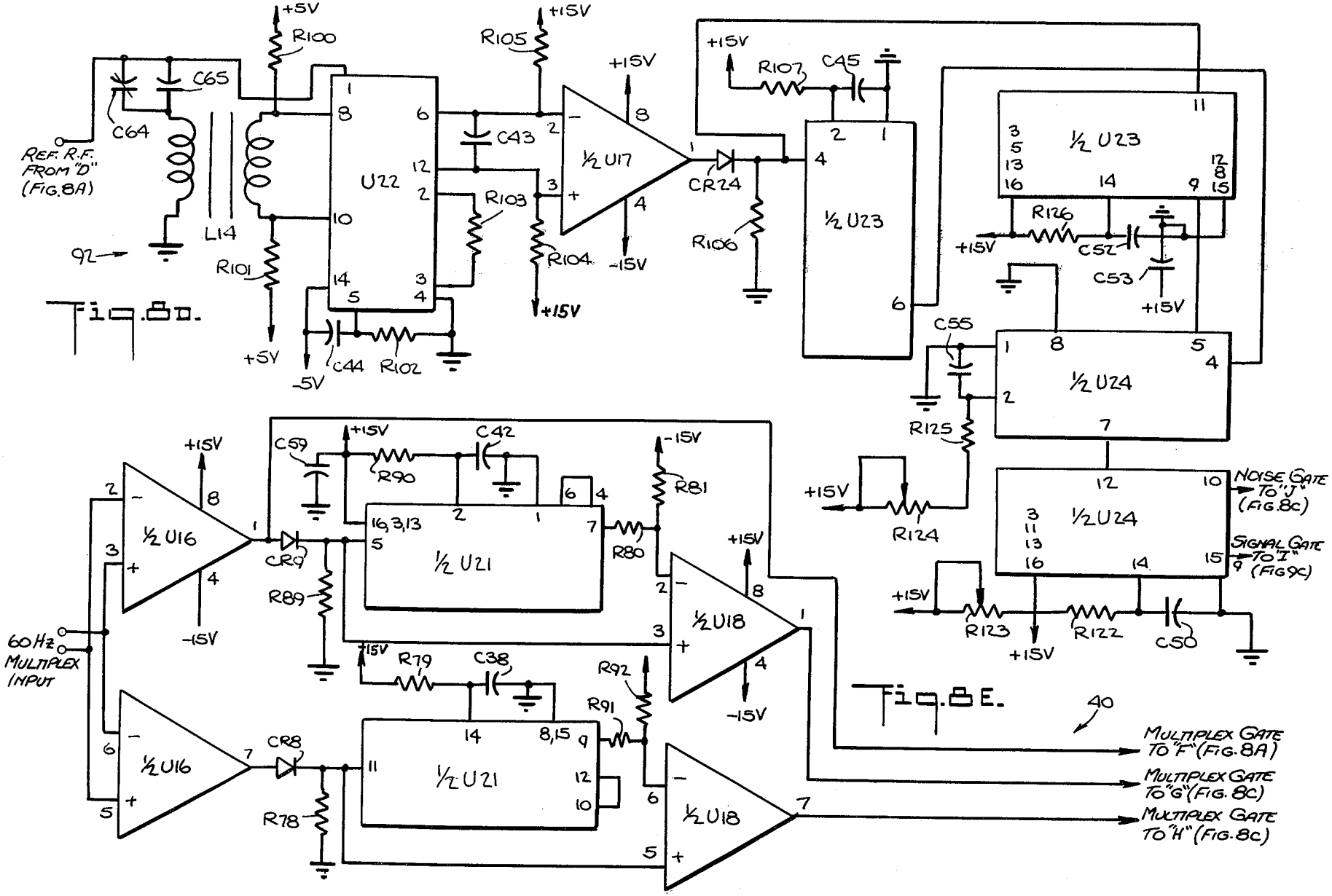

FIGS. 7A and 7B show the detailed circuits of the preferred transmitter used with the present invention; and FIGS. 8A, 8B, 8C, 8D and 8E show the detailed circuits of the preferred receiver used with the present invention. In these circuit diagrams, resistors, capacitors, coils, transformers and transistors are shown in standard form. In addition there are shown various integrated circuits and the pin numbers shown on the drawings correspond to the pin or terminals of the actual circuits. In some cases, two separate circuit elements share a common integrated circuit chip; and those elements are indicated with a common number on the drawing but with different letter suffixes.

The following is a table of values for the various components of the transmitter and receiver, corresponding to the number and letter designations in the drawings.

TABLE II

TRANSMITTER COMPONENTS (FIGS. 7A and 7B)

| Resistor | Value (ohms) | Resistor | Value (ohms) |
|---|---|---|---|
| R1 | 100 | R26 | 12K |
| R2 | 2.2K* | R27 | 680 |
| R3 | 20K | R28 | 680 |

TABLE II-continued

TRANSMITTER COMPONENTS (FIGS. 7A and 7B)

| | | | |
|---|---|---|---|
| R4 | 130K | R29 | 2.2K |
| R5 | 50K | R30 | 2.2K |
| R6 | 330 | R31 | 2.2K |
| R7 | 3.9K | R32 | 2.2K |
| R8 | 1K | R33 | 47 |
| R9 | 680 | R34 | 47 |
| R10 | 2K | R35 | 47 |
| R11 | 1K | R36 | 47 |
| R13 | 100 | R37 | 220 |
| R14 | 330 | R38 | 220 |
| R15 | 220 | R39 | 220 |
| R16 | 10K | R40 | 220 |
| R17 | 10K | R41 | 24 |
| R18 | 10K | R42 | 24 |
| R19 | 10K | R43 | 24 |
| R20 | 10K | R44 | 24 |
| R21 | 330 | R45 | 2.4K |
| R22 | 6.2K | | |
| R23 | 100 | | |
| R24 | 300 | | |
| R25 | 100 | | |

*K = 1000

| Capacitor | Value (microfarads) | Capacitor | Value (microfarads) |
|---|---|---|---|
| C1 | 0.1 | C17 | 0.002 |
| C2 | 0.1 | C18 | 0.002 |
| C3 | 15 | C19 | 0.002 |
| C4 | 220 PF* | C20 | 0.002 |
| C5 | 0.1 | C21 | 0.002 |
| C6 | 0.1 | C22 | 0.002 |
| C7 | 15 | C23 | 50 PF |
| C8 | 15 | C24 | 50 PF |
| C9 | 82 PF | C25 | 50 PF |
| C10 | 2-22 PF | C26 | 50 PF |
| C11 | 0.01 | C27 | 0.1 |
| C12 | 0.1 | C28 | 0.1 |
| C13 | 0.1 | C29 | 80-380 PF |
| C14 | 0.01 | C30 | 39 PF |
| C15 | 0.002 | C31 | 39 PF |
| C16 | 0.002 | C32 | 80-380 PF |

*PF = picofarads

| Transformers and Inductances | Number of Turns and Inductance | |
|---|---|---|
| | Primary | Secondary |
| T1 | 4T - 0.38 MH* | 53T - 67 MH |
| T2 | 30T - 50 MH | 30T - 50 MH |
| T3 | 30T - 50 MH | 8T - 3.5 MH |
| T3 | 6T - 2.7 MH | 20T - 30 MH |
| L1 | — 167 MH | — — |
| L2 | — 167 MH | — — |
| **Inductance Coils** | **Inductance** | |
| L1 | 167 MH | |
| L2 | 167 MH | |
| **Transistors** | **Source and Type** | |
| Q1, Q4, Q3, Q4 | Motorola MPS 5172 | |
| Q5, Q7, Q9, Q11 | Motorola 2N 2219 | |
| Q6, Q8, Q10, Q12 | Motorola 2N 2905 | |
| **Integrated Circuits** | **Source and Type** | |
| U1, U3 | Texas Instruments TL082 | |
| U2 | Signetics 561B | |

*MH = microhenries

TABLE III

RECEIVER COMPONENTS (FIGS. 8A-E)

| Resistor | Value (ohms) | Resistor | Value (ohms) |
|---|---|---|---|
| R1 | 300 | R31 | 10K |
| R2 | 300 | R32 | 3.9K* |
| R3 | 100 | R33 | 3.9K |
| R4 | 12K | R34 | 20K |
| R5 | 12K | R35 | 100K |
| R6 | 5.6K | R36 | 3.9K |
| R7 | 5.6K | R37 | 100K |
| R8 | 5.6K | R38 | 10K |
| R9 | 5.6K | R39 | 10K |

TABLE III-continued

RECEIVER COMPONENTS (FIGS. 8A-E)

| | | | |
|---|---|---|---|
| R10 | 15K | R40 | 10K |
| R11 | 15K | R41 | 1K |
| R12 | 6.8K | R42 | 1K |
| R13 | 100 | R43 | 51K |
| R14 | 6.8K | R44 | 390 |
| R15 | 12K | R45 | 390 |
| R16 | 12K | R46 | 390 |
| R17 | 6.8K | R47 | 6.2K |
| R18 | 6.8K | R48 | 3.9K |
| R19 | 240 | R49 | 62K |
| R20 | 240 | R50 | 3.9K |
| R21 | 47 | R51 | 20K |
| R22 | 47 | R52 | 3.9K |
| R23 | 9.1K | R53 | 62K |
| R24 | 4.7K | R54 | 10K |
| R25 | 4.7K | R55 | 10K |
| R26 | 4.7K | R56 | 10K |
| R27 | 4.7K | R57 | 1K |
| R28 | 390 | R58 | 1K |
| R29 | 390 | R59 | 51K |
| R30 | 390 | R60 | 12K |
| R61 | 10K | R95 | 1.5K |
| R62 | 10K | R96 | 30K |
| R63 | 10K | R97 | 1K |
| R64 | 5.1K | R98 | 3.9K |
| R65 | 430 | R99 | 3.9K |
| R66 | 390 | R100 | 82 |
| R67 | 10K | R101 | 82 |
| R68 | 430 | R102 | 4.7K |
| R69 | 3.9K | R103 | 1K |
| R70 | 100K | R104 | 4.7K |
| R71 | 3.9K | R105 | 4.7K |
| R72 | 20K | R106 | 10K |
| R73 | 3.9K | R107 | 3K |
| R74 | 100K | R108 | 1.5K |
| R75 | 10K | R109 | 30K |
| R76 | 10K | R110 | 1.5K |
| R77 | 1K | R111 | 30K |
| R78 | 10K | R112 | 1K |
| R79 | 62K | R113 | 10K |
| R80 | 10K | R114 | 250K |
| R81 | 30K | R115 | 10K |
| R82 | 10K | R116 | 250K |
| R83 | 10K | R117 | 1K |
| R84 | 1.5K | R118 | 1K |
| R85 | 30K | R119 | 1K |
| R86 | 10K | R120 | 10K |
| R87 | 250K | R121 | 250K |
| R88 | 1K | R122 | 27K |
| R89 | 10K | R123 | 20K |
| R90 | 62K | R124 | 20K |
| R91 | 10K | R125 | 30K |
| R92 | 30K | R126 | 3K |
| R93 | 10K | R130 | 12K |
| R94 | 10K | R131 | 240 |
| R132 | 3K | | |
| R133 | 2K | | |
| R134 | 3K | | |
| R135 | 390 | | |
| R136 | 39K | | |

*K = 1000

| Capacitor | Value (microfarads) | Capacitor | Value (microfarads) |
|---|---|---|---|
| C1 | 80-380 PF* | C33 | 0.1 |
| C2 | 0.01 | C34 | 0.1 |
| C3 | 0.01 | C35 | 0.01 |
| C4 | 5.5-65 PF | C36 | 0.002 |
| C5 | 82 PF | C37 | 0.1 |
| C6 | 0.01 | C38 | 0.1 |
| C7 | 0.01 | C39 | 15 |
| C8 | 5.5-65 PF | C40 | 15 |
| C9 | 82 PF | C41 | 0.001 |
| C10 | 0.1 | C43 | 0.002 |
| C11 | 0.01 | C44 | 0.1 |
| C12 | 0.1 | C45 | 0.1 |
| C13 | 0.01 | C46 | 15 |
| C14 | 0.1 | C47 | 15 |

TABLE III-continued

RECEIVER COMPONENTS (FIGS. 8A-E)

| | | | |
|---|---|---|---|
| C15 | 0.1 | C48 | 15 |
| C16 | 0.1 | C49 | 0.001 |
| C17 | 0.1 | C50 | 0.1 |
| C18 | 0.1 | C51 | 15 |
| C19 | 0.1 | C52 | 0.1 |
| C20 | 0.1 | C53 | 0.1 |
| C21 | 0.01 | C55 | 0.1 |
| C22 | 0.002 | C56 | 15 |
| C23 | 0.1 | C57 | 15 |
| C24 | 0.1 | C60 | 15 |
| C25 | 0.1 | C61 | 15 |
| C26 | 0.1 | C62 | 0.001 |
| C27 | 0.01 | C63 | 0.001 |
| C28 | 0.002 | C64 | 2-22 PF |
| C29 | 0.1 | C65 | 82 PF |
| C30 | 0.002 | C66 | 2.2 |
| C31 | 0.1 | C67 | 2.2 |
| C32 | 0.1 | C68 | 15 |

*PF = picoforads

| Transformers and Inductances | Number of Turns and Inductance | |
|---|---|---|
| | Primary | Secondary |
| L1 | 47T - 67 MH* | — — |
| L2 | 56T - 82 MH | — — |
| L3 | 30T - 50 MH | 5T - 1.4 MH |
| L4 | 53T - 67 MH | 4T - 0.4 MH<br>4T - 0.4 MH |
| L5 | 40T - 1760 MH | 9T - 89 MH |
| L6 | 40T - 1760 MH | — — |
| L7 | 9T - 89 MH | 40T - 1760 MH |
| L8 | 60T - 3960 MH | 21T - 485 MH |
| L9 | 60T - 3960 MH | — — |
| L10 | 21T - 485 MH | 60T - 3960 MH |
| L11 | 30T - 990 MH | 5T - 27 MH |
| L12 | 30T - 990 MH | — — |
| L13 | 5T - 27 MH | 30T - 990 MH |
| L14 | 53T - 67 MH | 10T - 2.4 MH |

| Transistors | Source and Type |
|---|---|
| Q1, Q2, Q3, Q4 | Motorola MPS 5172 |
| Q5, Q6, Q7, Q8 | Motorola MPS 5172 |
| Q9, Q10, Q11, Q12 | Motorola MJE 1100 |

*MH = Microhenries

| Control Rectifiers | Type | Control Rectifiers | Type |
|---|---|---|---|
| CR1 | 1N914 | CR20 | 1N914 |
| CR2 | 1N914 | CR21 | 1N914 |
| CR3 | 1N914 | CR22 | 1N914 |
| CR4 | 1N914 | CR23 | L.E.D. |
| CR5 | 1N914 | CR24 | 1N914 |
| CR6 | 1N914 | CR25 | 1N914 |
| CR7 | 1N914 | CR26 | 1N914 |
| CR8 | 1N914 | CR27 | L.E.D. |
| CR9 | 1N914 | CR28 | 1N914 |
| CR10 | 1N914 | CR29 | 1N914 |
| CR11 | 1N914 | CR30 | L.E.D. |
| CR12 | 1N914 | CR31 | 1N914 |
| CR13 | 1N914 | CR32 | L.E.D. |
| CR14 | 1N914 | CR33 | 1N2070 |
| CR15 | 1N914 | CR34 | 1N2070 |
| CR16 | L.E.D. | CR35 | 1N2070 |
| CR17 | 1N914 | CR36 | 1N2070 |
| CR18 | L.E.D. | CR37 | 1N914 |
| CR19 | 1N914 | CR38 | 1N914 |

| Integrated Circuits | Source and Type |
|---|---|
| U18 | Texas Instruments TL082 |
| U19 | Motorola MC1496L |
| U20 | Motorola 14528 |
| U21 | Motorola 14528 |
| U22 | Motorola MC1496L |
| U23 | Motorola 14528 |
| U24 | Motorola 14528 |

Having thus described the invention with particular reference to the preferred forms thereof, it will be obvi-ous to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. A method of detecting the unauthorized carrying of protected articles through an interrogation zone wherein targets affixed to articles being carried through the zone cause electromagnetic field disturbances which, when received, result in target produced electrical signals having a predetermined spectral characteristic and wherein noise is also present in said interrogation zone in the form of electromagnetic field disturbances which, when received result in noise produced electrical signals of different predetermined spectral characteristics, said method comprising the steps of receiving said electromagnetic field disturbances to convert same to said target and noise produced electrical signals, applying said electrical signals to at least three frequency selective channels in parallel, each channel being tuned to pass a different frequency within the target produced signal spectrum, comparing the output signal amplitudes from the channels to ascertain their relative values and producing a detection signal when the relative values of the compared signal amplitudes correspond within a predetermined range, to the corresponding relative values of target produced signals.

2. A method according to claim 1 wherein the signals in the different frequency selective channels are subjected to different amounts of gain such that the relative values of output signal amplitudes from the channels for target produced signals is different from the relative values of output signal amplitude from the channels for noise produced signals.

3. A method according to claim 1 wherein said detection signal is produced when the relative values of the compared signal amplitudes corresponds more closely to the predetermined relative values of target produced signals than to the predetermined relative values of noise produced signals.

4. A method according to claim 1 wherein the signals in the different frequency selective channels are subjected to different amounts of gain such that the order of output signal amplitude from the channels for target produced signals is different from the order of output signal amplitude for noise produced signals, wherein the output signal amplitudes from the frequency selective channels are compared to ascertain their order and wherein a detection signal is produced when the order of the compared signals corresponds to that for target produced signals.

5. A method according to claim 4 wherein the signals in the higher frequency selective channels are subjected to greater gain than the signals in the lower frequency selective channels.

6. A method according to claim 5 wherein the signals in a lower frequency selective channel are compared separately with signals in each of two higher frequency selective channels and wherein said detection signal is produced when the signal in said lower frequency channel is at an amplitude between the amplitudes of the signals in said two higher frequency selective channels.

7. A method according to claim 1 wherein the signals in each frequency selective channel are subjected to detection and are passed through a low pass filter prior to comparison of their amplitudes.

8. A method according to claim 1 wherein said targets are resonant electrical circuits resonant at about 1970 kilohertz, wherein said targets are subjected to a swept frequency interrogating signal which includes 1970 kilohertz, wherein said electrical signals are passed through three frequency selective channels in parallel, one channel being tuned to pass signals in the vicinity of eight kilohertz, a second channel being tuned to pass signals in the vicinity of twelve kilohertz and the third channel being tuned to pass signals in the vicinity of sixteen kilohertz, wherein the gain of the second and third channels is approximately four times the gain of the first channel and wherein the outputs of the channels are compared to produce a detection signals when the output amplitude from said one channel is less than the output amplitude from said second channel and greater than the output amplitude from said third channel.

9. A method according to claim 1 wherein said targets are resonant electrical circuits and wherein an electromagnetic interrogation field is generated in said zone at a frequency which sweeps repetitively over a range which includes the resonant frequency of said resonant electrical circuits.

10. A method according to claim 9 wherein said detection signals which occur while said electromagnetic interrogation field is close to the resonant frequency of said targets are passed into a signal channel, wherein said detection signals which are produced at other times are directed into a noise channel, wherein the signals in said noise and signal channels are accumulated and wherein an alarm is generated when the number of signals accumulated in said signal channel exceeds, by a predetermined amount, the number of signals accumulated in said noise channel.

11. Electronic theft detection apparatus for detecting the unauthorized carrying of protected articles through an interrogation zone, said apparatus comprising targets adapted to be affixed to articles carried through the zone, said targets being characterized in that they cause electromagnetic field disturbances in said zone, which disturbances, when received, result in target produced electrical signals having a predetermined spectral characteristic which is different from predetermined spectral characteristics of noise produced electrical signals which result from the reception of other electromagnetic disturbances in the interrogation zone, means for receiving the electromagnetic field disturbances in said interrogation zone and for converting same to target and noise produced electrical signals, at least three frequency selective channels connected in parallel with each other to receive said electrical signals, each channel being tuned to pass a different frequency within the target produced signal spectrum, means for comparing the output signal amplitudes from the frequency selective channels to ascertain their relative values and means for producing a detection signal when the relative values of the compared signal amplitudes corresponds, within a predetermined range, to the corresponding relative values of target produced signals.

12. Electronic theft detection apparatus according to claim 11 wherein the frequency selective channels have different gain characteristics such that the relative values of the output signal amplitudes from the channels for target produced signals is different from the relative values of the output signal amplitude from the channels for noise produced signals.

13. Electronic theft detection apparatus according to claim 11 wherein said means for producing a detection signal operates in response to the predetermined relative values of target produced signals to the predetermined relative values of noise produced signals.

14. Electronic theft detection apparatus according to claim 11 wherein the frequency selective channels have different gain characteristics such that the order of output signal amplitude from the channels for target produced signals is different from the order of output signal amplitude for noise produced signals, wherein the means for comparing the output signal amplitude from the frequency selective channels operates to ascertain their order of amplitude and wherein said means for producing a detection signal operates when the order of the compared signals corresponds to that for target produced signals.

15. Electronic theft detection apparatus according to claim 14 wherein the frequency selective channels which pass higher frequency signals have higher gain characteristic than the frequency selective channels which pass lower frequency signals.

16. Electronic theft detection apparatus according to claim 15 wherein said means for comparing the output signal amplitudes from the frequency selective channels comprises first and second signal amplitude level comparators, means for applying signals from one frequency selective channel as one input to each of said comparators, means for applying signals from a second frequency selective channel as a second input to the other of said other comparators, said one comparator being constructed to produce an output when the amplitude of the signal at its said one input is of greater amplitude than the amplitude of the signal at its second input, said other comparator being constructed to produce an output when the signal at its said one input is less than the amplitude of the signal at its said second input and an AND gate connected to receive outputs from said comparators and to produce an output when said comparators produce simultaneous outputs.

17. Electronic theft detection apparatus according to claim 11 wherein the frequency selective channels each include a detector and a low pass filter.

18. Electronic theft detection apparatus according to claim 11 wherein said apparatus includes resonant circuit targets tuned to resonate at a frequency of about 1970 kilohertz and means producing in said interrogation zone a swept frequency interrogating signal which includes 1970 kilohertz, and wherein said frequency selective channels comprise a first channel tuned to pass signals in the vicinity of eight kilohertz, a second channel tuned to pass signals in the vicinity of twelve kilohertz and a third channel tuned to pass signals in the vicinity of sixteen kilohertz, said second and third channels each having a signal gain characteristic approximately four times the signal gain characteristic of said first channel, a first signal level comparator connected to receive outputs from said first and second channels and to produce an output when the amplitude of the output from the first channel is less than the amplitude of the output from the second channel, a second signal level comparator connected to receive outputs from said first and third channels and to produce an output when the amplitude of the output from said first channel is greater than the amplitude of the output from said third channel and an AND gate connected to receive the output from said first and second comparator to produce a detection signal whenever outputs from said comparators occur simultaneously.

19. Electronic theft detection apparatus according to claim 11 wherein said apparatus comprises means for generating an electromagnetic interrogation field in said zone at a frequency which sweeps cyclically over a predetermined range and wherein said targets each comprise a resonant electrical circuit tuned to resonate at a frequency within said range.

20. Electronic theft detection apparatus according to claim 19 wherein there are provided a signal channel and a noise channel, and means for directing detection signals produced while said interrogation field is at or close to the resonant frequency of said targets into said signal channel, means for directing detection signals produced at other times into said noise channel, accumulator means in each of said signal and noise channels, and comparator means connected to said accumulator means and operative to produce an alarm actuating output when the number of signals in said signal channel exceeds, by a predetermined amount, the number of signals accumulated in said noise channel.

* * * * *

UNITED STATES PATENT AND TRADEMARK OFFICE

CERTIFICATE OF CORRECTION

PATENT NO. : 4,321,586

DATED : March 23, 1982

INVENTOR(S) : MICHAEL N. COOPER and PETER A. POKALSKY

It is certified that error appears in the above—identified patent and that said Letters Patent is hereby corrected as shown below:

Column 19, line 6 (Claim 13), after "signals", insert -- and --;

Column 19, lines 33 and 34 (Claim 16), delete the phrase "the other of said comparators, said one", and substitute -- said first comparator, means for applying signals from a third frequency selective channel as a second input to said second comparator, said first --;

Column 19, line 38 (Claim 16), delete "other" and substitute -- second --.

Signed and Sealed this

*Fifteenth* Day of *June 1982*

[SEAL]

*Attest:*

GERALD J. MOSSINGHOFF

*Attesting Officer*

*Commissioner of Patents and Trademarks*